US006663921B1

(12) United States Patent
Quigel

(10) Patent No.: US 6,663,921 B1
(45) Date of Patent: Dec. 16, 2003

(54) COLLAPSIBLE CHRISTMAS TREE

(76) Inventor: Cameron F. Quigel, 9769 E. Highway 26, Stockton, CA (US) 95215

( * ) Notice: Subject to any disclaimer, the term of this patent is extended or adjusted under 35 U.S.C. 154(b) by 0 days.

(21) Appl. No.: 10/251,250

(22) Filed: Sep. 20, 2002

(51) Int. Cl.[7] ..... F21W 121/04

(52) U.S. Cl. ..... 428/12; 428/7; 428/9; 428/13; 428/19; 428/18; 428/20; 428/32; 362/123; 362/252; 248/122.1; 248/125.1

(58) Field of Search ..... 428/7, 9, 12, 13, 428/542.2, 19, 20, 17, 18, 32; 248/122.1, 125.1, 163.1, 431, 175, 157, 274.1, 295.11, 342; 362/123, 252, 249, 217, 218, 219

(56) References Cited

U.S. PATENT DOCUMENTS

| | | | | | |
|---|---|---|---|---|---|
| 3,704,366 | A | | 11/1972 | Korb et al. | 240/10 T |
| 3,723,723 | A | | 3/1973 | Lerner | 240/10 T |
| 3,808,082 | A | | 4/1974 | Steiber | 161/22 |
| 4,040,343 | A | * | 8/1977 | De Lucchi | 99/421 |
| 5,094,893 | A | * | 3/1992 | Snider | 428/18 |
| 5,359,502 | A | | 10/1994 | Cantin | 362/123 |
| 5,413,825 | A | * | 5/1995 | Chaikin | 428/18 |
| 5,746,504 | A | * | 5/1998 | Dodson | 362/252 |
| 5,964,013 | A | * | 10/1999 | Bergstrom | 24/16 PB |
| 6,012,590 | A | * | 1/2000 | Sanchez | 211/13.1 |
| 6,027,228 | A | * | 2/2000 | Adams et al. | 362/252 |
| 6,062,701 | A | | 5/2000 | Hines | 362/123 |
| 6,206,561 | B1 | * | 3/2001 | Hefti | 366/129 |
| 6,224,231 | B1 | * | 5/2001 | Personius | 362/123 |
| 6,334,694 | B1 | * | 1/2002 | Huang | 362/123 |
| 6,386,728 | B1 | * | 5/2002 | Colonna | 362/123 |

FOREIGN PATENT DOCUMENTS

JP 8-179172 * 12/1994 ..... C03C/25/02

OTHER PUBLICATIONS

US 2002/0138950.*

* cited by examiner

*Primary Examiner*—Deborah Jones
*Assistant Examiner*—Vivek Koppikar
(74) *Attorney, Agent, or Firm*—Henneman & Saunders; Larry E. Henneman, Jr.

(57) ABSTRACT

A novel decorative structure includes a length of strand material, having a plurality of individual strands twisted with respect to one another and fixed with respect to one another near a first end of the strands, and a twisting member having a plurality of apertures formed therein, each adapted to receive a respective one of the individual strands therethrough. In a particular embodiment the twisting member is a disc, such that when the twisting member is advanced from a second end of the strands to the first end, the strand material is caused to unwind. Similarly, when the twisting member is advanced from the first end to the second end of the strands, the strand material is caused to wind up. When unwound, the strands retain a decorative helical shape, and give the appearance of a Christmas tree.

67 Claims, 4 Drawing Sheets

FIG. 2
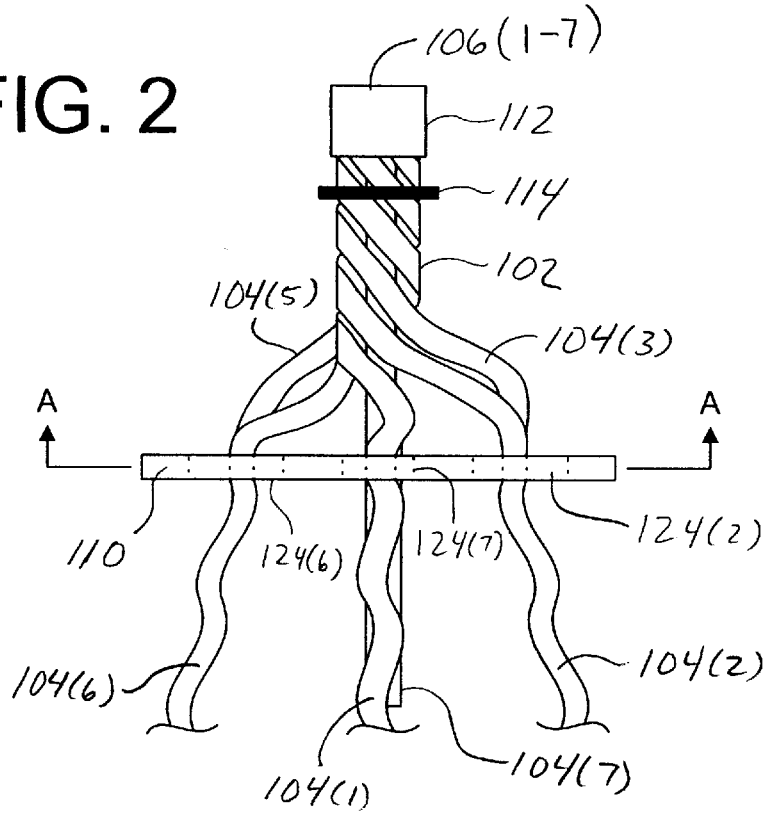
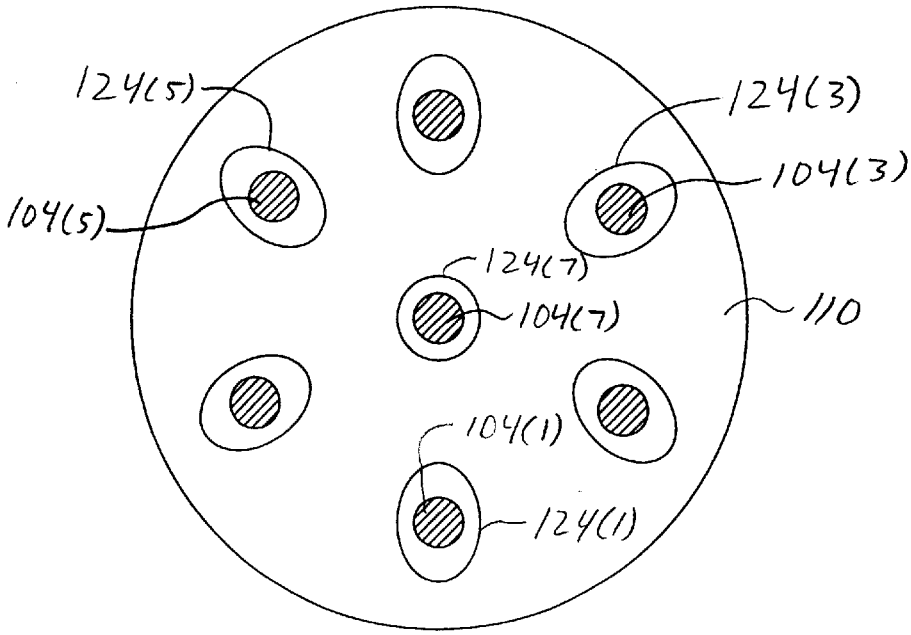
FIG. 3

COLLAPSIBLE CHRISTMAS TREE

BACKGROUND OF THE INVENTION

1. Field of the Invention

This invention relates generally to decorative structures, and more particularly to a collapsible Christmas tree that is easy to erect, easy to collapse, compact for storage, and whose structure has a decorative shape when erected.

2. Description of the Background Art

During the holiday seasons, homes are commonly adorned in and out with festive decorations. One common decoration is the artificial Christmas tree.

Artificial trees are designed and manufactured in both indoor and outdoor varieties. Indoor and outdoor type artificial trees each suffer several disadvantages. Indoor trees, for example, require large amounts of storage space because they are generally formed from many interconnecting components that have fragile branches and pine needles attached thereto for decoration. Additionally, the components, because of their interconnecting complexities, require a substantial amount of time to setup.

One type of outdoor artificial tree is essentially a conical wire frame structure, to which decorations can be attached. The wires used in such frames is typically straight, and so the frame structures are generally plain, and apart from their conical shape and attached decorations bear little resemblance to a real tree. Further, the wire frame structures are typically formed as a single unit, and therefore require a relatively large amount of storage space when not being displayed.

What is needed, therefore, is a decorative structure that is suitable for indoor and outdoor use, that requires little assembly or disassembly, is compact and easy to store, and has a structure with a decorative shape suggestive of a Christmas tree.

SUMMARY

The present invention overcomes the problems associated with the prior art by providing a decorative structure that is easy to erect and to collapse, is compact for storage, and whose structure has a decorative shape suggestive of a Christmas tree.

The decorative structure includes a length of strand material and a twisting member. The strand material includes a plurality of individual strands that are twisted with respect to one another, and are fixed with respect to one another near first ends of the strands. The twisting member includes a plurality of apertures formed therein, each adapted to receive a respective one of the individual strands therethrough. In a particular embodiment, the decorative structure resembles a Christmas tree, and the twisting member is a disc defining a separate aperture for each strand of the strand material. In a more particular embodiment, at least one of the apertures is oblong in shape.

To open the tree the twisting member is advanced from a position near second ends of the strands toward the first ends of the strands, causing the strand material to unwind. When unwound, the strands retain a decorative helical shape, suggestive of the layered branches of a Christmas tree. To collapse the tree, the twisting member is advanced from a position near the first ends of the strands toward the second ends of the strands, causing the strand material to wind up.

In a particular embodiment, the decorative structure includes a coupling device disposed near the first end of the strands for fixing the strands together with respect to one another. In a more particular embodiment, the strand material is strand steel, and the coupling device is a weld. In still a more particular embodiment, the strand steel includes a straight center strand which is cut substantially shorter than the remaining strands of the strand material.

Optionally, the decorative structure includes a cover (e.g., a metal cap) for covering the first ends of the strands. In a particular embodiment, the cover is adapted such that a decorative object can be mounted thereto.

An optional strand retainer holds the strands in a wound state. Examples of strand retainers include, but are not limited to, an annular ring having and inner diameter slightly larger than the outer diameter of the wound strands, and/or a removable strap that can be wrapped around the wound strands.

An optional twisting member retainer prevents the strands from disengaging the twisting member. Possible twisting member retainers include, but are not limited to, a separate device (e.g., a grommet, a clamp, removable feet, etc.) coupled to at least one of the strands of the strand material, and/or a deformation (e.g., a bend, an enlargement) in at least one of the strands of the strand material.

Coating the individual strands, while not essential, protects the decorative structure, enhances the decorative appearance, and makes it easier to wind and unwind the strand material. In a particular embodiment, the coating is a white powder coating. Alternatively, the strands can be painted.

Attachment devices are provided for attaching decorations (e.g., Christmas lights, ornaments, etc.) to the decorative structure. In a particular embodiment, the attachment device is a detachable clip having a first end for attaching to one of the individual strands and a second end for attaching to the decoration. The attachment devices, as well as other aspects of the invention even if not explicitly stated, are not considered to be an essential element of the present invention. For example, the decorative structure of the present invention can be used with a decorative slip-over cover, thereby eliminating the need for attachment devices.

In another particular embodiment, the decorative structure includes a plurality of helical strands, each strand having a first end and a second end, a coupling device fixing the strands together near the first ends of the strands, and a positioning device adapted to selectively position the second ends of the strands a spaced distance from one another. The positioning device is further adapted to selectively position the second ends of the strands in a close together relationship, for example for storage.

A method for erecting a decorative structure is also described. The method includes the steps of providing a length of strand material including a plurality of individual strands twisted with respect to one another, and fixed together at a first end with respect to one another. The method further includes unwinding the strands of the strand material from a second end to the first end using a twisting member. The twisting member defines a plurality of apertures, each aperture adapted to receive a respective one of the individual strands therethrough. The method of erecting a decorative structure further includes an optional step of releasing a strand retainer, either prior to or during the step of unwinding the strands. In a particular method, the step of unwinding the strands includes twisting the twisting member about a longitudinal axis oriented generally inline with the strand material. In yet another particular method, the method of erecting a decorative structure includes standing the decorative structure upright, such that the decorative structure is supported by the unwound ends of the strands.

A more particular method for erecting a decorative structure further includes rewinding the strands of the strand material by moving a twisting member from the first end of the strand material toward the second end of the strand material, while rotating said twisting member about a longitudinal axis of said strand material. Optionally, the method further includes the step of applying a retainer near the second end of said strand material to prevent the unwinding of the strands.

A method for manufacturing a decorative structure is also disclosed. The method includes the steps of providing a length of strand material including a plurality of individual strands twisted with respect to one another, coupling the strands with respect to one another near a first end of the strand material, providing a twisting member having a plurality of apertures formed therein, and positioning a second end of each of the individual strands in a respective one of the apertures of the twisting member.

The method of manufacturing the decorative structure further includes an optional step of providing a cover for covering the first end of the strands, an optional step of providing a strand retainer for retaining the strands in a wound state, and an optional step of providing a twisting member retainer for retaining at least one individual strand in a respective aperture of the twisting member.

BRIEF DESCRIPTION OF THE DRAWINGS

The present invention is described with reference to the following drawings, wherein like reference numbers denote substantially similar elements:

FIG. 2 is a front plan view of a first end of the decorative structure of FIG. 1;

FIG. 3 is a cross-sectional view taken along section line A—A through the twisting member of FIG. 2;

DETAILED DESCRIPTION

The present invention overcomes the problems associated with the prior art, by providing a collapsible decorative structure (e.g., a Christmas tree) that is compact and easy to store, requires little assembly or disassembly, and has a structure that retains a decorative appearance when erected. In the following description, numerous specific details are set forth (e.g., number of individual strands in strand material, use of steel strand material, etc.) in order to provide a thorough understanding of the invention. Those skilled in the art will recognize, however, that the invention may be practiced apart from these specific details. In other instances, details of well known processes (e.g. strand material fabrication, powder coating, etc.) have been omitted, so as not to unnecessarily obscure the present invention.

Figure 1:
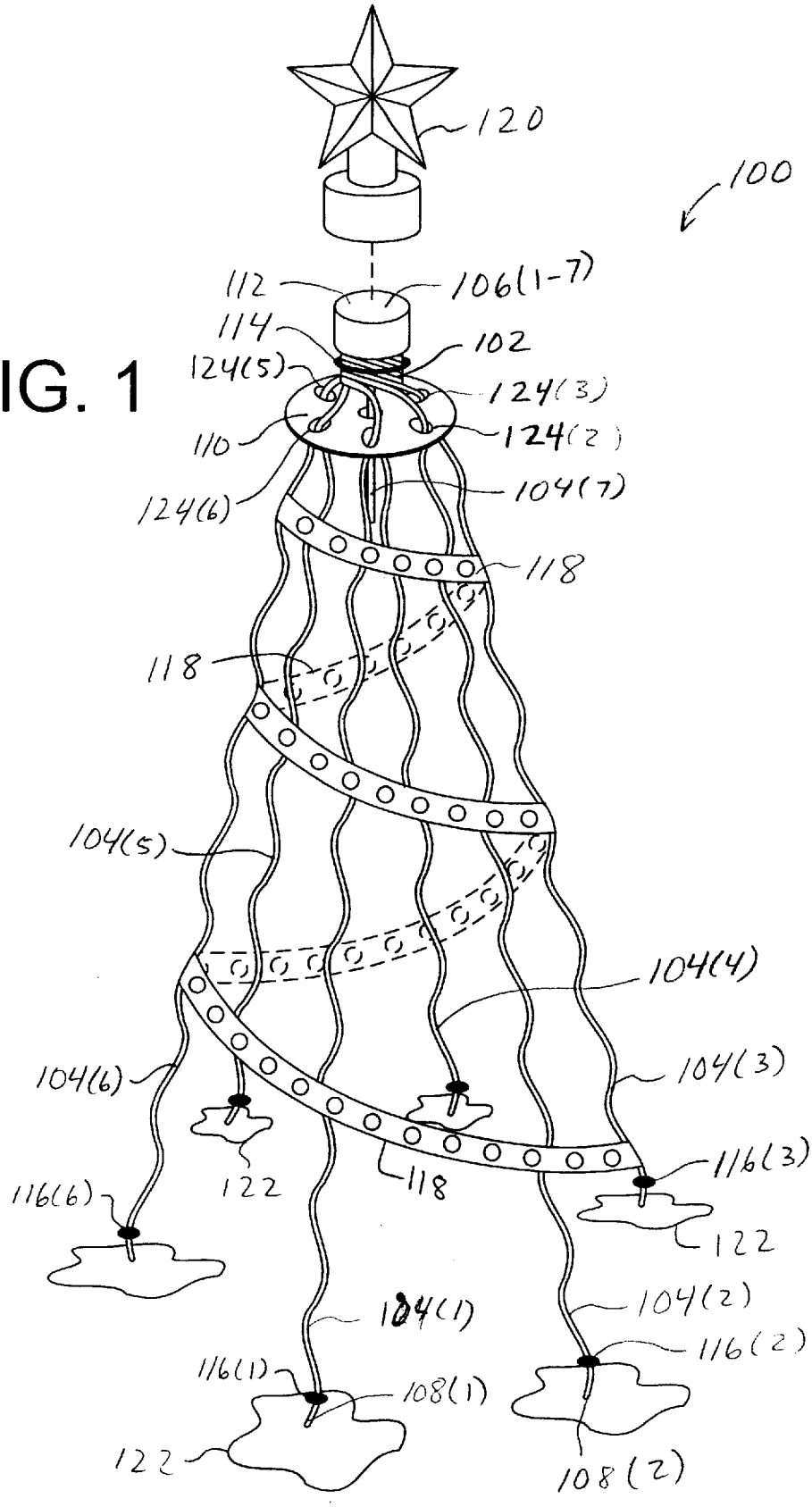
FIG. 1 is a perspective view showing an embodiment of a decorative structure of the present invention in a display state.

FIG. 1 shows a decorative structure 100 according to one embodiment of the present invention. Decorative structure 100 includes a length of strand material 102, that is composed of a plurality of individual strands 104(1–7), each having a first end 106(1–7) and a second end 108(1–7). Decorative structure 100 further includes a twisting member 110, an end cover 112, a strand retainer 114, and a plurality of twisting member retainers 116(1–6). In addition, decorative structure 100 includes a decoration 118 draped around strands 104(1–6), and a decorative cap 120 adapted to mount over end cover 112.

In the erected state shown in FIG. 1, decorative structure 100 is supported on a support surface 122 by the second ends 108(1–6) of strands 104(1–6). Individual strands 104(1–6) are fixed in position with respect to each other at their first ends 106(1–7), which are wound around straight center strand 104(7). Twisting member 110 defines a plurality of apertures 124(1–7), through each of which a respective one of strands 104(1–7) passes. When twisting member 110 is positioned near first ends 106(1–7) of strands 104(1–7), second ends 108(1–7) are positioned in a spaced apart relationship by twisting member 110. As twisting member 110 is moved toward second ends 108(1–7), as will be described in greater detail hereinafter, second ends 108(1–7) are drawn into a close together relationship. Thus, twisting member 110 functions as a positioning device that selectively positions second ends 108(1–7) in either a spaced apart relationship (erected state) or a close together relationship (collapsed state).

Cover 112 is a metal cap that covers first ends 106(1–7) of strands 104(1–7) for safety and aesthetics. Strand retainer 114 keeps strands 104(1–7) in a wound relationship when decorative structure 100 is in the collapsed state, as will be described below. In this particular embodiment, strand retainer 114 is an annular ring having an inner diameter slightly larger than the outer diameter of strand material 102 in its wound state. Decoration 118 represents Christmas lights, garland, and the like which can be draped around or fastened to decorative structure 100. Decorative cap 120 is adapted to detachably mount over cover 112, to facilitate the use of a variety such decorations. Optionally, decorative cap 120 and cover 112 can be formed integrally to reduce the number of parts.

In the present embodiment, decorative structure 100 is a Christmas tree, and will hereinafter be referred to as such. It should be noted, however, that the decorative structure described herein can be used for other occasions or purposes (e.g., theater scenery, landscape decorations, etc.), in addition to the Christmas tree embodiment shown.

Also in the present embodiment, strand material 102 is formed from 0.6" strand steel having six twisted strands (e.g., strands 104(1–6)) and a straight center strand (e.g., strand 104(7)). Manufacturing Christmas tree 100 from strand steel is inexpensive because strand steel is readily available in industry (e.g., in concrete reinforcement), as well as, provides durability to tree 100. Additionally, Christmas tree 100 can be manufactured from scrap pieces (e.g. a few feet long) which are of little or no value for conventional strand steel applications. It should also be noted that alternate materials may be used to manufacture tree 100 including, but not limited to, molded plastics, other metals, wood, and/or fiber products.

The present invention provides several advantages over the prior art. One advantage is that Christmas tree 100 can be quickly and easily erected and collapsed. Twisting member 110 facilitates the winding and unwinding of strand material 102. When twisting member 110 is advanced from a position near first ends 106(1–7) to a position near second ends 108(1–7) of strands 104(1–7), and twisting member 110 is simultaneously rotated about a longitudinal axis of the strand material, the individual strands 104(1–6) of strand material 102 are caused to wind up into a twisted relationship. Conversely, advancing twisting member 110 from second ends 108(1–7) to first ends 106(1–7) of strands 104(1–7) causes strands 104(1–7) to unwind into the open relationship depicted in FIG. 1.

It should be noted that twisting member 110 is not an essential element of the present invention. For example, an alternate tree can be formed, without a twisting member, from a plurality of helical (or otherwise wavy) strands fixed together near their first ends by a coupling device (e.g., a weld, clamp, etc.). A simple solid structure (e.g., a cone, a pyramid, a sphere, etc.) placed between the helical strands would serve as a positioning device to hold the second ends of the strands in a spaced apart relationship, instead of the twisting member. Thus, to erect the alternative tree, the user would simply wedge the positioning device up between the strands near enough to the fixed first ends to obtain the desired spacing of the second ends. Similarly, to collapse the alternate tree, the user need only remove the positioning device. Because this embodiment does not include a twisting member, the helical strands could not be wound and unwound, but would merely be gathered together for storage. Optionally, the positioning device can be mounted to or supported by a center strand. As another option, the positioning device can include grooves for receiving and positioning the individual strands.

In its wound state, tree 100 can be easily transported and stored. As previously described, prior art artificial trees require substantial storage space. Tree 100, when in its wound state, is not significantly larger than the strand steel cable from which it is formed (see FIG. 4). Therefore, tree 100 requires significantly less storage space than conventional artificial Christmas trees.

Another advantage provided by tree 100 is that strands 104(1–6) retain their twisted shape when unwound. The helical shape of strands 104(1–6) provide a wavy appearance suggestive of the boughs of a pine tree. This is a significant improvement over the straight wire frame structures of the prior art.

Strands 104(1–7) are individually coated for appearance and protection. The inventor has determined that strands 104(1–7) can be easily powder coated when tree 100 is in its erect state. Powder coating strands 104(1–7) adds a durable, colorful finish, and provides rust protection. Optionally, strands 104(1–7) can be individually painted to obtain similar benefits.

Strands 104(1–7) can be powder coated or painted in a variety of colors depending on intended use and individual preference. For example, tree 100 is powder coated white to suggest a snow covered Christmas tree. As another example, tree 100 could be painted green, suggestive of an evergreen tree. Obviously, if tree 100 was formed from a plastic, the plastic could be colored to give the tree a colored appearance.

To summarize, Christmas tree 100 can be wound up for storage as follows. First, decoration 118 is removed from cap 112. Next, individual strands 104(1–6) are wound together by advancing twisting member 110 toward free second ends 108(1–7)) of strands 104(1–6). As twisting member 110 is advanced along the length of strand material 102, twisting member 110 is twisted about the longitudinal axis of strand material 102. Twisting member retainers 116(1–6) prevent twisting member 110 from coming off of second ends 108(1–6) of strands 104(1–6). Finally, strands 104(1–6) are secured in their twisted state by sliding strand retainer 114 from first ends 106(1–7) to a position near second ends 108(1–6) of strands 104(1–6) to prevent the unraveling strands 104(1–6).

From its wound state, tree 100 is erected as follows. First, strand retainer 114 is released by moving strand retainer 114 from second ends 108(1–6) to a position near first ends 106(1–7) of strands 104(1–7). Next, advancing twisting member 110 toward first ends 106(1–7) of strands 104(1–7) causes strand material 102 to unwind. When twisting member 110 reaches a position near first ends 106(1–7) of strands 104(1–7), second ends 108(1–6) of strands 104(1–6) are held in an open, spaced apart relationship, such that second ends 108 of strands 104(1–6) can support tree 100 on ground 122. Finally, tree 100 can be decorated by fastening (e.g. with attachment device 500, clips, hooks, etc.) decoration 118 to strands 104(1–7), and by placing decorative cap 120 over cover 112.

FIG. 2 is a front plan view of a portion of collapsible tree 100 near first ends 106(1–7). There are several notable features of tree 100, which are clearly shown in FIG. 2. First, center strand 104(7) is shown straight and cut substantially shorter than the remaining individual strands 104(1–6) because of its non-helical shape. Additionally, individual strands 104(1–6) are twisted around center strand 104(7) near first ends 106(1–7). Retaining at least a portion of center strand 104(7) is beneficial to retain proper position and winding of helical strands 104(1–6). Finally, in the present view twisting member 110 is shown as a flat disc, having each of strands 104(1–7) passing therethrough, and is centered about a longitudinal axis of strand material 102 passing through center strand 104(7).

FIG. 3 is a cross-sectional view taken along section line A—A of FIG. 2 showing twisting member 110 in greater detail. In the present embodiment, twisting member 110 is formed (e.g., machined, molded, etc.) from plastic, but it should be understood that alternate materials including, but not limited to, metal, fiberglass, wood, etc. may be used. Twisting member 110 is a round disc, having apertures 124(1–6) situated around the perimeter and aperture 124(7) located in the center. Apertures 124(1–6) are oblong to facilitate easier winding and unwinding of strands 104(1–6), which vary in separation from center as they travel through their respective apertures 124(1–6) when twisting member 110 is advanced along strand material 102. Center aperture 124(7) is circular because center strand 104(7) is straight. Optionally, twisting member 110 can be manufactured with finger grooves (not shown) about the perimeter, to make twisting member easier to grip.

Figure 4:
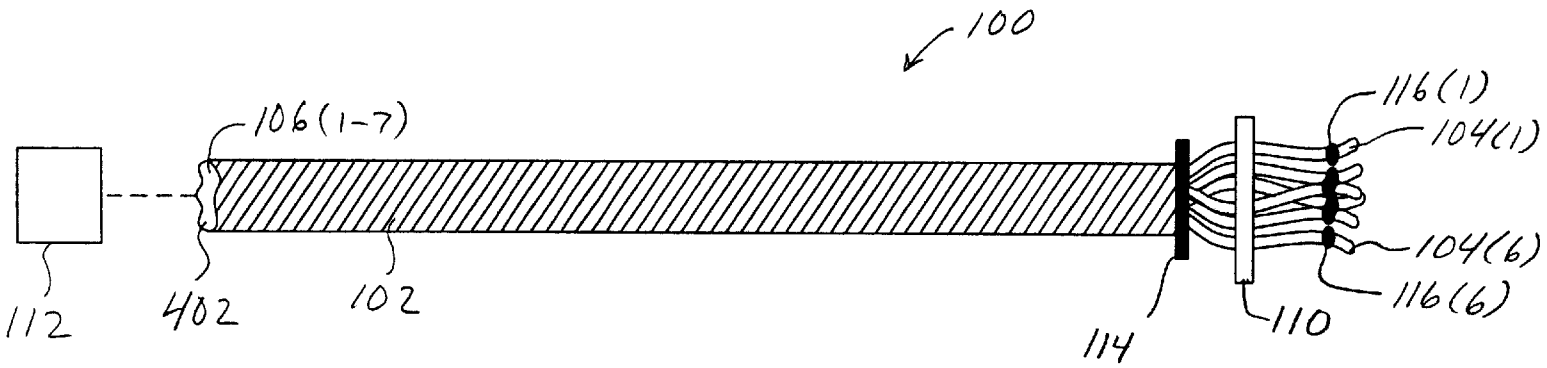
FIG. 4 is a partially exploded view showing the decorative structure of FIG. 1 in a storage state.

FIG. 4 shows a partially exploded view of Christmas tree 100, in its wound up, collapsed state. Cover 112 is removed from first ends 106(1–7) to expose a weld 402. Weld 402 mechanically couples strands 104(1–7) together at first ends 106(1–7). Weld 402 is most easily formed during manufacture using an oxy-acetylene torch, wherein the strand material 102 is melted, but could be formed with alternate methods including, but not limited to, stick, MIG, and TIG welds, or brazing. Alternately, strands 104(1–7) can be fixed together using a clamp or strap secured around first ends 106(1–7), and/or a suitable epoxy.

Substitutions for other components of tree 100 can also be made without departing from the scope of the invention. For example, a deformation (e.g., a bend, extrusion, melted portion, etc.) in at least one of strands 104(1–6) to retain twisting member 110 on strands 104(1–7) could be substituted for twisting member retainers 116(1–6). As another example, a strap wrapped around strands 104(1–6) near second ends 108(1–7) could be substituted for strand retainer 114.

Figure 5:
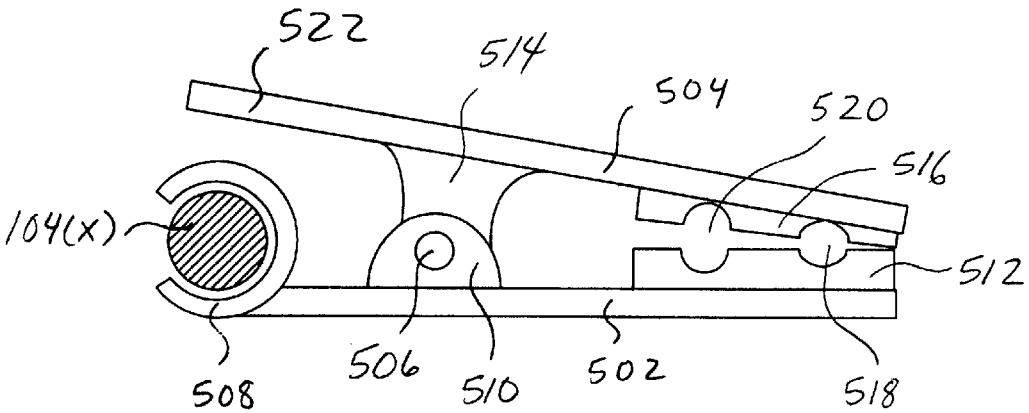
FIG. 5 is a top plan view of a fastening clip for fastening decorations to the decorative structure of FIG. 1.

FIG. 5 shows a top view of an attachment device 500 for attaching decorations (e.g., decoration 118) to tree 100. Attachment device 500 includes a lower jaw 502 and an upper jaw 504 coupled to lower jaw 502 by a pin 506. Lower jaw 502 includes a strand clamp 508, a lower pin support 510, and a lower tooth 512. Similarly, upper jaw 504 includes an upper pin support 514 and an upper tooth 514. Lower tooth 512 and upper tooth 514, when together, define a small guideway 518 and a large guideway 520 for grasping decorations of various sizes. Compression is placed on lower tooth 512 and upper tooth 514 by a spring (not shown) acting about pin 506 on lower jaw 502 and upper jaw 504.

In the current view, attachment device 500 is a detachable clip and can selectively engage one of individual strands 104(x) when tree 100 is erected by pressing strand clamp 508 onto strand 104(x). Lower pin support 510 engages upper pin support 514 at pin 506. When attached to tree 100, upper jaw 504 is pivotal about pin 506, permitting upper tooth 516 to separate from lower tooth 512 when force is applied to a pressure end 522 of clip 500. With upper jaw 504 in an open position, decorations can be retained in small guideway 518 or large guideway 520, when upper jaw 504 is released. The number of clips required depends on various factors such as the size of the tree, the character of the decorations, the environment, etc.

Figure 6:
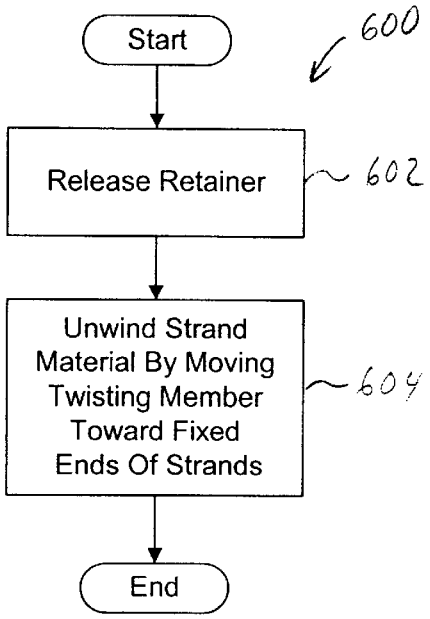
FIG. 6 is a flowchart summarizing one method of erecting the decorative structure of FIG. 1.

FIG. 6 is a flowchart summarizing one method 600 of erecting decorative structure 100 according to the present invention. In a first step 602, strands 104(1–6) are released by moving strand retainer 114 toward first ends 106(1–7) of strands 104(1–7). Then, in a second step 604, strands 104(1–6) are unwound by advancing twisting member 110 toward first ends 106(1–7) of strands 104(1–6). Note that strand retainer 114 can be moved either before or as twisting member 110 is advanced.

Figure 7:
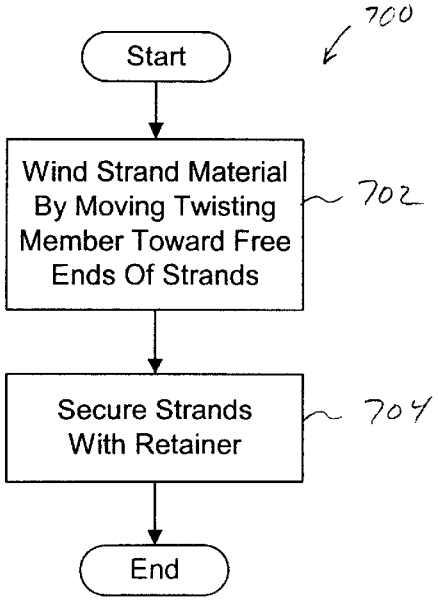
FIG. 7 is a flowchart summarizing one method of collapsing the decorative structure of FIG. 1.

FIG. 7 is a flowchart summarizing one method 700 of collapsing decorative structure 100 according to the present invention. In a first step 702 strands 104(1–6) are wound up by advancing twisting member 110 toward the free ends 108(1–6) of strands 104(1–6). Next, in a second step 704, strands 104(1–6) are secured with strand retainer 114 to prevent unraveling, by sliding strand retainer 114 from a position near first ends 106(1–7) to a position near second ends 108(1–6).

Figure 8:
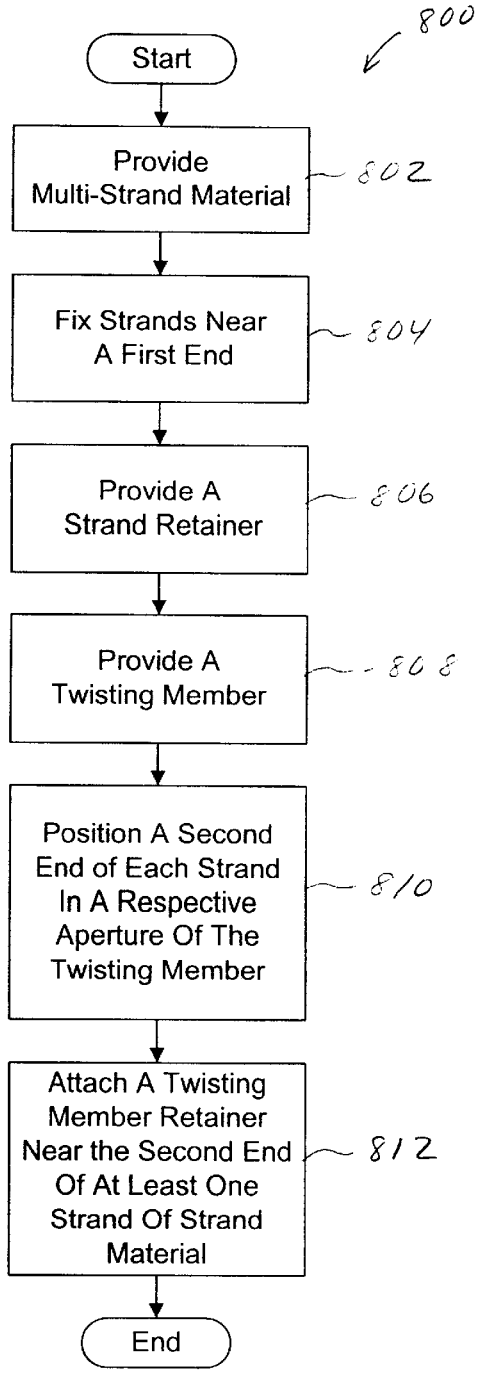
FIG. 8 is a flowchart summarizing one method of manufacturing the decorative structure of FIG. 1.

FIG. 8 is a flowchart summarizing one method 800 of manufacturing decorative structure 100 according to the present invention. In a first step 802, a length of strand material (e.g., strand steel) is provided. Then in a second step 804, strands 104(1–7) are fixed together (e.g., welded, clamped, strapped, etc.) near first ends 106(1–7). Next, in a third step 806, strand retainer 114 is provided, and slid over second ends 108(1–7) of strands 104(1–7) to prevent individual strands 104(1–7) from unraveling. Then, in a fourth step 808, twisting member 110 is provided for winding and unwinding strands 104(1–6) of strand material 102, and in a fifth step 810, second ends 108(1–7) of strands 104(1–7) are positioned in respective apertures 124(1–7) of twisting member 110. Finally, in a sixth step 812, at least one of twisting member retainers 116(1–6) are attached near second ends 108(1–6) of strands 104(1–6) to retain twisting member 110 on strands 104(1–6).

The description of particular embodiments of the present invention is now complete. Many of the described features may be substituted, altered, or omitted without departing from the scope of the invention; For example, an alternate strand retainer 114 (e.g., a removable strap), may be substituted for the annular ring embodiment shown. As another example, the decorative structure can be used to display decorations (e.g., birds, fruit, etc.) other than Christmas decorations. These and other deviations from the particular embodiments shown will be apparent to those skilled in the art, particularly in view of the foregoing disclosure.

I claim:

1. A decorative structure, comprising:

a length of strand material, said strand material including a plurality of individual helical strands twisted with respect to one another, said strands being fixed with respect to one another near first ends of said strands, a coupling device adapted to fix said strands with respect to one another near first ends of said strands; and a twisting member having a plurality of apertures formed therein, each of said apertures adapted to receive a respective one of said individual strands therethrough;

wherein each of said strands is positioned through a respective one of said apertures, and wherein advancing said twisting member from second ends of said strands toward said first ends of said strands causes said strand material to unwind.

2. A decorative structure according to claim 1, wherein advancing said twisting member from said first ends of said strands toward said second ends of said strands causes said strand material to wind up.

3. A decorative structure according to claim 1, wherein said strand material comprises strand steel.

4. A decorative structure according to claim 3, wherein said coupling device comprises a weld.

5. A decorative structure according to claim 4, wherein:

said strand steel includes a straight center strand; and said center strand is cut substantially shorter than the remaining strands of said strand material.

6. A decorative structure according to claim 1, wherein said coupling device comprises a clamp.

7. A decorative structure according to claim 1, further including a cover for covering said first ends of said strands.

8. A decorative structure according to claim 7, wherein said cover comprises a metal cap.

9. A decorative structure according to claim 7, further including a decorative object adapted to mount to said cover.

10. A decorative structure according to claim 1, further including a coating individually applied to at least one of said strands of said strand material.

11. A decorative structure according to claim 10, wherein said coating comprises a powder coating.

12. A decorative structure according to claim 10, wherein said coating comprises at least one layer of paint.

13. A decorative structure according to claim 1, wherein said twisting member comprises a disc.

14. A decorative structure according to claim 13, wherein said disc includes at least one aperture for each said individual strand of said strand material.

15. A decorative structure according to claim 14, wherein:

said strand material comprises strand steel having a straight center strand cut near said first end of said strand material; and said disc defines one of said apertures near the center of said disc for receiving said center strand.

16. A decorative structure according to claim 1, wherein at least one of said apertures formed in said twisting member is oblong in shape.

17. A decorative structure according to claim 1, further including a strand retainer for retaining said strands in a wound state.

18. A decorative structure according to claim 17, wherein said strand retainer comprises an annular ring, said annular ring having an inner diameter slightly larger than the diameter of said strand material when said strands are in said wound state.

19. A decorative structure according to claim 18, wherein said annular ring is disposed between said first ends of said strands and said twisting member, whereby moving said twisting member toward said first ends causes said annular ring to move toward said first ends of said strands.

20. A decorative structure according to claim 17, wherein said strand retainer comprises a strap for wrapping around said strands.

21. A decorative structure according to claim 1, further comprising at least one twisting member retainer for retaining at least one of said strands in one of said apertures of said twisting member.

22. A decorative structure according to claim 21, wherein said twisting member retainer comprises a separate device fixed to at least one of said individual strands near a second end of said one of said individual strands.

23. A decorative structure according to claim 21, wherein said twisting member retainer comprises a deformation in at least one of said individual strands near a second end of said one of said individual strands.

24. A decorative structure according to claim 23, wherein said deformation comprises a bend formed near said second end of said one of said individual strands.

25. A decorative structure according to claim 1, further including a plurality of attachment devices for attaching decorations to said decorative structure.

26. A decorative structure according to claim 25, wherein said attachment devices comprise detachable clips, said detachable clips having a first end for attaching to one of said individual strands and a second end for attaching to said decorations.

27. The decorative structure according to claim 1, whereby twisting said twisting member about a longitudinal axis of said strand material will cause said individual strands of said strand material to wind or unwind with respect to one another depending on the direction of rotation of said twisting member.

28. A method for erecting a decorative structure, comprising:

providing a length of strand material, said strand material including a plurality of individual strands twisted with respect to one another, said strands fixed with respect to one another at a first end of said strand material;

unwinding said strands of said strand material from a second end to said first end of said strand material using a twisting member, said twisting member having a plurality of apertures formed therein, each of said apertures adapted to receive a respective one of said individual strands therethrough; and standing said decorative structure upright, such that said decorative structure is supported by the unwound ends of said strands.

29. A method for erecting a decorative structure according to claim 28, further including releasing a strand retainer to facilitate the unwinding of said strands.

30. A method for erecting a decorative structure according to claim 29, wherein said step of releasing said strand retainer includes sliding an annular ring, having an inner diameter slightly larger than the outer diameter of said strand material, from a position near a second end of said strand material to a position near said first end of said strand material.

31. A method for erecting a decorative structure according to claim 29, wherein said step of releasing said strand retainer includes removing a strap from around said strand material near a second end of said strand material.

32. The method for erecting a decorative structure according to claim 28, where said step of unwinding said strands includes the step of twisting said twisting member about an axis oriented generally inline with said strand material.

33. A method for erecting a decorative structure according to claim 28, further including rewinding said strands of said strand material by moving said twisting member from said first end of said strand material toward said second end of strand material, while rotating said twisting member about a longitudinal axis of said strand material.

34. A method for erecting a decorative structure according to claim 33, wherein said step of rewinding said strand material includes applying a retainer near said second end of said strand material to prevent the unwinding of said strands.

35. A method for erecting a decorative structure according to claim 34, wherein said step of applying a retainer includes sliding an annular ring to a position near said second end of said strand material.

36. A method for erecting a decorative structure according to claim 34, wherein said step of applying a retainer includes wrapping a strap around said strand material near said second end of said strand material.

37. A method for manufacturing a decorative structure, comprising:

providing a length of strand material, said strand material including a plurality of individual helical strands twisted with respect to one another;

coupling said strands with respect to one another near a first end of said strand material;

providing a twisting member having a plurality of apertures formed therein; and positioning a second end of each of said individual strands in a respective one of said apertures of said twisting member;

wherein advancing said twisting member from second ends of said strands toward said first ends of said strands causes said strand material to unwind.

38. A method for manufacturing a decorative structure according to claim 37, wherein said step of providing a length of strand material includes providing a length of strand steel.

39. A method for manufacturing a decorative structure according to claim 38, wherein said step of coupling said strands at said first end of said strand material includes welding said strands together.

40. A method for manufacturing a decorative structure according to claim 38, wherein said step of providing said twisting member includes providing a twisting member having a number of said apertures formed therein greater than or equal to the number of said individual strands of said strand material.

41. A method for manufacturing a decorative structure according to claim 40, further includes shortening a center one of said individual strands.

42. A method for manufacturing a decorative structure according to claim 37, further comprising a step of coating said individual strands of said strand material.

43. A method for manufacturing a decorative structure according to claim 42, wherein said step of coating said individual strands of said strand material includes powder coating said individual strands of said strand material.

44. A method for manufacturing a decorative structure according to claim 42, wherein said step of coating said individual strands of said strand material includes painting said individual strands of said strand material.

45. A method for manufacturing a decorative structure according to claim 37, wherein said step of coupling said strands includes clamping said strands together with a clamp.

46. A method for manufacturing a decorative structure according to claim 37, wherein said step of coupling said strands includes melting said strands together.

47. A method for manufacturing a decorative structure according to claim 37, wherein said step of coupling said strands includes welding said strands together.

48. A method for manufacturing a decorative structure according to claim 37, further comprising providing a strand retainer for retaining said strands in a wound state.

49. A method for manufacturing a decorative structure according to claim 48, wherein said step of providing said strand retainer includes providing an annular ring around said strand material.

50. A method for manufacturing a decorative structure according to claim 48, wherein said step of providing said strand retainer includes providing a strap to wrap around said strand material near said second end of said strand material.

51. A method for manufacturing a decorative structure according to claim 37, further comprising a step of providing a twisting member retainer to retain at least one of said strands within a respective one of said apertures of said twisting member.

52. A method for manufacturing a decorative structure according to claim 51, wherein said step of providing said twisting member retainer comprises securing a device to at least one of said strands.

53. A method for manufacturing a decorative structure according to claim 51, wherein said step of providing said twisting member retainer includes deforming at least one of said individual strands near said second end of said individual strand.

54. A method for manufacturing a decorative structure according to claim 53, wherein said step of deforming at least one of said individual strands includes making a bend near said second end of said strand.

55. A method for manufacturing a decorative structure according to claim 37, further comprising a step of providing a cover at said first end of said strands for covering said first end of said strands.

56. A method for manufacturing a decorative structure according to claim 55, wherein said step of providing said cover comprises fitting a metal cap over said first end.

57. A method for manufacturing a decorative structure according to claim 56, further comprising mounting a decoration over said metal cap.

58. A method for manufacturing a decorative structure according to claim 37, further comprising a step of providing a plurality of fastening devices, said fastening devices for fastening at least one decoration to at least one of said individual strands.

59. A method for manufacturing a decorative structure according to claim 58, wherein said step of providing said fastening devices includes providing a plurality of clips for fastening said at least one decoration to said at least one said individual strands.

60. A decorative structure, comprising:

a plurality of helical strands, each strand having a first end and a second end;

a coupling device fixing said strands with respect to one another near said first ends of said strands;

a positioning device adapted to selectively position said second ends of said strands in a spaced apart relationship;

wherein said helical strands are formed of a semi-rigid material, whereby said decorative structure is self-supporting on said second ends of said strands.

61. A decorative structure according to claim 60, wherein said positioning device is further adapted to selectively position said second ends of said strands in a close together relationship.

62. A decorative structure according to claim 61, further comprising a retaining device for retaining said second ends of said strands in said close together relationship.

63. A decorative structure according to claim 60, further comprising a cap disposed to cover said first ends of said strands.

64. The decorative structure according to claim 60, further comprising a plurality of fastening devices for fastening at least one decoration to said decorative device.

65. A decorative structure according to claim 1, wherein said strands are formed of a semi-rigid material, whereby said decorative structure is self-supporting on second ends of said strands.

66. A method for erecting a decorative structure according to claim 28, wherein said individual strands are helical in shape.

67. A method for manufacturing a decorative structure according to claim 37, wherein said strands are formed of a semi-rigid material, whereby said decorative structure is self-supporting on said second ends of said strands.

* * * * *